US006332668B1

(12) United States Patent
Ahn

(10) Patent No.: US 6,332,668 B1
(45) Date of Patent: Dec. 25, 2001

(54) APPARATUS FOR AND METHOD OF EJECTING INK OF AN INK-JET PRINTER

(75) Inventor: Byung-Sun Ahn, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 08/899,808

(22) Filed: Jul. 24, 1997

(30) Foreign Application Priority Data

Jul. 24, 1996 (KR) ..... 96-30047

(51) Int. Cl.[7] ..... B41J 2/04
(52) U.S. Cl. ..... 347/54
(58) Field of Search ..... 347/54, 55, 61

(56) References Cited

U.S. PATENT DOCUMENTS

| | | | | |
|---|---|---|---|---|
| 4,275,290 | * | 6/1981 | Cielo et al. | 347/61 |
| 4,345,262 | * | 8/1982 | Shirato et al. | 347/10 |
| 4,502,054 | * | 2/1985 | Brescia et al. | 347/55 |
| 4,723,129 | * | 2/1988 | Endo et al. | 347/56 |
| 4,914,562 | * | 4/1990 | Abe et al. | 347/63 |
| 5,132,707 | | 7/1992 | O'Neill . | |
| 5,157,418 | * | 10/1992 | Tamura | 347/58 |
| 5,368,683 | * | 11/1994 | Altavela et al. | 216/27 |
| 5,400,061 | | 3/1995 | Horio et al. . | |
| 5,455,998 | | 10/1995 | Miyazono et al. . | |
| 5,502,472 | * | 3/1996 | Suzuki | 347/69 |
| 5,519,424 | | 5/1996 | Scardovi et al. . | |
| 5,622,805 | | 4/1997 | Uehara et al. . | |
| 5,635,966 | | 6/1997 | Keefe et al. . | |
| 5,648,805 | | 7/1997 | Keefe et al. . | |
| 5,682,188 | * | 10/1997 | Meyer et al. | 347/61 |
| 5,787,327 | * | 7/1998 | Matsushita et al. | 399/130 |

FOREIGN PATENT DOCUMENTS

| | | | | |
|---|---|---|---|---|
| 4505418 | * | 9/1991 | (EP) | 347/54 |
| 2-185446 | * | 7/1990 | (JP) | 347/61 |
| 2-185446 | * | 9/1991 | (JP) | 347/54 |
| 405269986 | * | 10/1993 | (JP) . | |

* cited by examiner

*Primary Examiner*—John Barlow
*Assistant Examiner*—Michael Brooke
(74) *Attorney, Agent, or Firm*—Robert E. Bushnell, Esq.

(57) ABSTRACT

An apparatus for ejecting ink in an ink-jet printer that ejects the ink out of the openings on the nozzle plate only by the vapor pressure of bubbles of gas generated on the surface of individual electrodes due to the electrolysis of the conductive ink by applying positive voltage to the individual electrodes wetted with the ink and negative voltage to a common electrode, without using a heater for heating the ink and a plurality of protective layers to protect the internal electrodes, thereby making it possible to realize a high speed printing operation for high frequency by a short impulse duration with low voltage.

36 Claims, 12 Drawing Sheets

APPARATUS FOR AND METHOD OF EJECTING INK OF AN INK-JET PRINTER

CLAIM OF PRIORITY

This application makes reference to, incorporates the same herein, and claims all benefits accruing under 35 U.S.C. §119 from an application for APPARATUS FOR AND METHOD OF EJECTING INK OF AN INK-JET PRINTER earlier filed in the Korean Industrial Property Office on Jul. 24, 1996 and there duly assigned Serial No. 30047/1996.

FIELD OF THE INVENTION

The present invention relates to an apparatus for and method of ejecting ink of an ink-jet printer and, more particularly, to an apparatus for and method of ejecting ink of an ink-jet printer by applying low voltage across individual electrodes and the nozzle plate formed in different layers to produce an electrolysis of the conductive ink and generate gas, and ejecting the ink to openings using the vapor pressure of the gas to form characters.

DISCUSSION OF RELATED ART

The notion of vaporizing ink in a chamber as a way to expel ink from an orifice can be seen, for example, in U.S. Pat. No. 5,400,061 for an Ink-Jet Printer Head to Horio et al. Conductive ink is positioned between two electrodes and is heated until it vaporizes, forcing liquid ink to be expelled from an orifice. U.S. Pat. No. 5,648,805 for an Inkiet Printhead Architecture For High Speed and High Resolution Printing to Keefe et al discloses an inkjet printhead that can operate at a frequency of 12 kHz and with a resolution of 600 dots per inch. What is needed is an inkjet printhead that not only operates at higher frequencies, but can do so by applying a low voltage to the printhead.

SUMMARY OF THE INVENTION

Accordingly, the present invention is directed to an apparatus for and method of ejecting in an ink-jet printer that substantially obviates one or more of the problems due to limitations and disadvantages of the related art.

An object of the present invention is to provide an apparatus for and method of ejecting ink of an ink-jet printer, whereby the ink can be ejected out of the openings on the nozzle plate only by the vapor pressure of bubbles of gas generated in the electrolysis of the conductive ink by applying positive(+) voltage to individual electrodes wetted with the ink and negative(−) voltage to a common electrode, without using a heater for heating the ink and a plurality of protective layers to protect the internal electrodes.

Another object of the present invention is to provide an apparatus for and method of ejecting ink of an ink-jet printer, which is simple in construction and requires no heat-resistant ink or heating resistor layer.

A flirter another object of the present invention is to provide an apparatus for and method of ejecting ink of an ink-jet printer, which can be easily operated by low voltage and low current.

Yet a further object of the present invention is to provide an apparatus for and method of ejecting ink of an ink-jet printer, in which a designated portion of the openings of the nozzle plate is surrounded by a conductive layer to stabilize the electrolysis of the conductive ink according to the electric energy applied to the electrodes in a chamber, thereby enhancing the quality of characters printed.

Still another object of the present invention is to provide an apparatus for and method of ejecting ink of an ink-jet printer, which has the nozzle plate made up of a conductive layer consisting of nickel or platinum in the portion of the nozzle plates wetted with ink in the ink chambers, and an insulating layer in the portion corresponding to the media, to concentrate energy generated through the conductive ink and prevent the leakage of electric energy.

To achieve these and other advantages and in accordance with the purpose of the present invention, as embodied and broadly described, an apparatus for ejecting ink of an ink-jet printer is made up of a plurality of individual electrodes located on a substrate whose surface is treated, with silicon dioxide, wetted with ink in a specified portion with the other portions being, insulated, and producing an electrolysis in the ink by first voltage applied to generate bubbles of gas on the surface thereof; nozzle plate used as a common electrode which correspond to the individual electrodes wetted with ink and are formed on different layers electrically isolated from one another, producing an electrolysis in the ink by electric power applied with the individual electrodes, and made up of conductive layers in the ink-wetted portion, insulating layers in a portion corresponding to media, and a plurality of openings for ejecting the ink onto the media there through; ink barriers for electrically isolating the ink-wetted portions on the surface of the individual electrodes from one another, increasing ejection force and linearity of vapor pressure to eject the ink to the openings by the bubbles, and providing walls for a fluid path to transfer the ink from an ink via through ink channels; ink chambers receiving the ink through the ink barriers and providing a space for generating bubbles by electric current density between the individual electrodes and nozzle plate; electrical connection means for supplying the first voltage to the individual electrodes and second voltage to the conductive layers of the nozzle plate to cause an electrolysis of the ink between the two electrodes; and switching devices for switching the electrical connection means by the signal of a CPU to control a printing operation. The first voltage is positive voltage and the second voltage is negative voltage and the ink is a conductive ink having a resistance in a predetermined range.

The present invention is applicable to a high speed printing operation for high frequency since a short impulse duration of low voltage is employed instead of a long impulse duration of high voltage to generates electric energy by joule heat. Since the bubbles are generated on the surface of the individual electrodes rather than at the edges of the electrodes, the corrosion can be reduced due to a uniform distribution of electric current.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
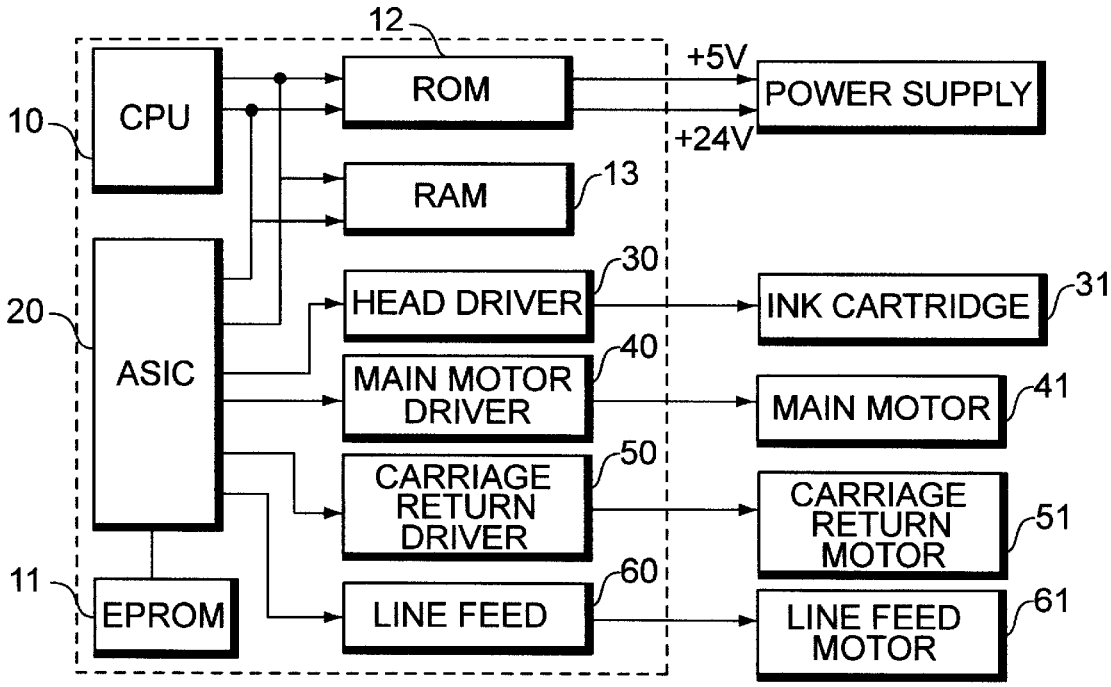
FIG. 1 is a block diagram of an earlier ink-jet printer.

The construction and operation of an earlier ink-jet printer is now described referring to FIG. 1. An earlier ink-jet printer includes a central processing unit (CPU) 10 that receives signals from a host computer (not illustrated) through printer interface, and reads a system program out of an erasable and programmable read only memory (EPROM) 11, storing initial values for the printing operation and various information necessary for the printing system, and then executes the system program, and produces control signals; a read only memory (ROM) 12 that stores programs for controlling the printer; and a random access memory (RAM) 13 which temporarily stores data of system operation.

The earlier ink-jet printer also includes an application-specific integrated circuit (ASIC) which implements necessary circuits for the control of CPU 10 and transmits data from CPU 10 to most of the peripheral components, a head driver 30 that controls the operation of ink cartridge 31 in response to an output control signal of CPU 10 transmitted thereto by ASIC portion 20, a main motor driving circuit 40 which serves to drive a main motor 41, a carriage motor driving circuit 50 that controls the operation of a carriage return motor 51, and a line feed motor driving circuit 60 which controls the operation of a line feed motor 61 for feeding paper and for outputting paper to a top output tray by using a stepping motor.

A print signal, transmitted to the print interface from the host computer, actuates motors 40, 50 and 60 in response to CPU 10's control signal, thus performing the printing operation. Ink cartridge 31 sprays small drops of ink on the paper through a plurality of orifices in a nozzle to form characters on the paper in a dot-matrix format.

Figure 2:
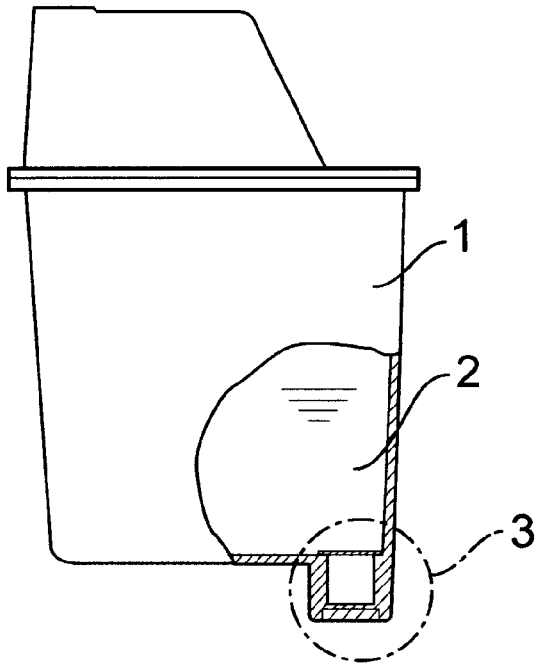
FIG. 2 is a sectional view of an ink cartridge of the ink cartridge shown in FIG. 2.

FIG. 2 is a sectional view of ink cartridge 31. Ink cartridge 31 includes ink 2 absorbed by a sponge held in a case 1, and an ink-jet printer head 3.

Figure 3:
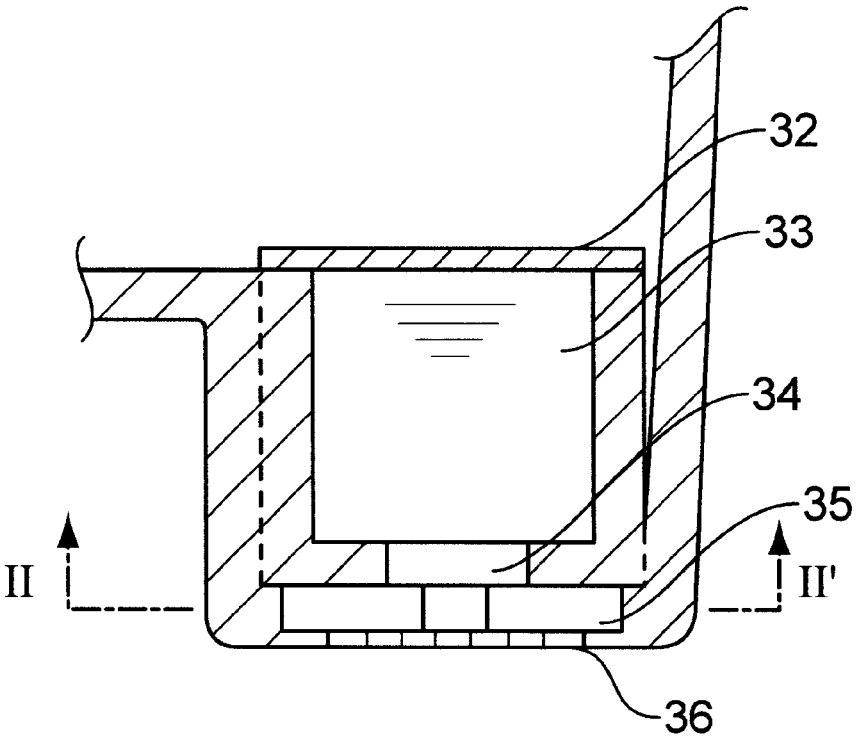
FIG. 3 is a view of the earlier ink-jet printer head.

FIG. 3 is an enlarged view of ink-jet portion 3. Inkjet printer head 3 is made up of a filter 32 which removes impurities from the ink, an ink stand pipe chamber 33 storing ink filtrated by filter 32, an ink via 34 that supplies a chip 35, having ink heating portions and ink chambers, with the ink delivered through ink stand pipe chamber 33, and a nozzle plate 36 having a plurality of orifices for expelling the ink, transmitted from ink via 34.

Figure 4:
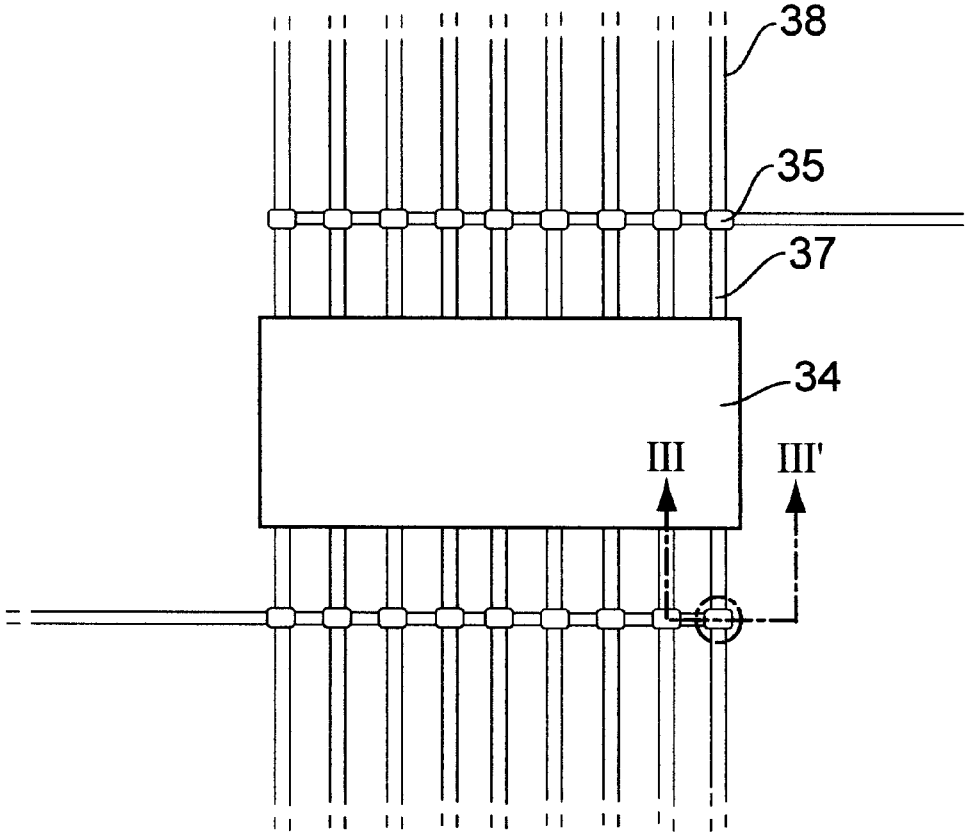
FIG. 4 is a sectional view as taken along line II–II' of FIG. 3.

FIG. 4 is a sectional view as taken along line II–II' of FIG. 3 FIG. 4depicts ink via 34 that provides the ink to the ink chambers (not illustrated) between nozzle plate 36 and chip 35, a plurality of ink channels 37 transmitting the ink to each orifice of nozzle plate 36 from ink via 34, ink chambers 39 that spray the ink supplied from ink channels 37, and a plurality of electrically-connecting means 38 which furnish power to ink chambers 39.

Figure 5:
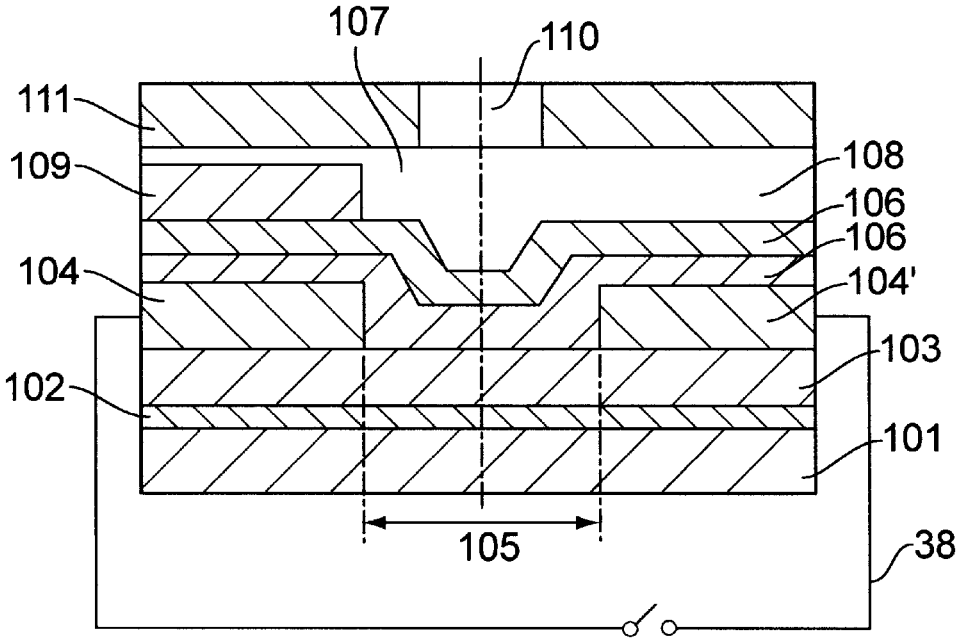
FIG. 5 is a sectional view as taken along line III–III' of FIG. 4.

FIG. 5 is a sectional view as taken along line III–III' of FIG. 4. Chip 35 includes a resistor layer 103 that is formed over a silicon dioxide ($SiO_2$) layer 102, created on a silicon substrate 101, and generates heat from electric energy; two electrode layers 104 and 104' which are formed over resistor layer 103 and provide electrical connection; multi-layer protective layers 106 which prevent heating portions 105, created in resistor layer 103 between two electrodes 104 and 104', from being eroded and deformed by chemical interaction with the ink; and ink chambers 107 producing ink bubbles in the ink by the heat generated by heating portions 105.

Chip 35 also includes ink channels 108 that serve as a passage for leading the ink from ink via 34 into ink chambers 107; ink barriers 109 that serve as a wall to form a space used for leading the ink from ink channels 108 into ink chambers 107; and a nozzle plate 111 having a plurality of orifices 110 through which every ink particle, pushed according to its volume change, is sprayed onto a print media.

Nozzle plate 111 and heating portions 105 are spaced a predetermined distance away from each other. A pair of electrodes 104 and 104' are connected with a pad (not illustrated) for electrical connection from the outside. This pad is electrically connected with a head controller (not illustrated) so that the ink particles are sprayed through each orifice of the nozzle. Each ink barrier 109 is formed such that the respective ink chambers 107 thereby created are linked with the common ink via 34 to receive a flow of ink, and thus guides the ink supply to the heating portions 105.

Figure 6:
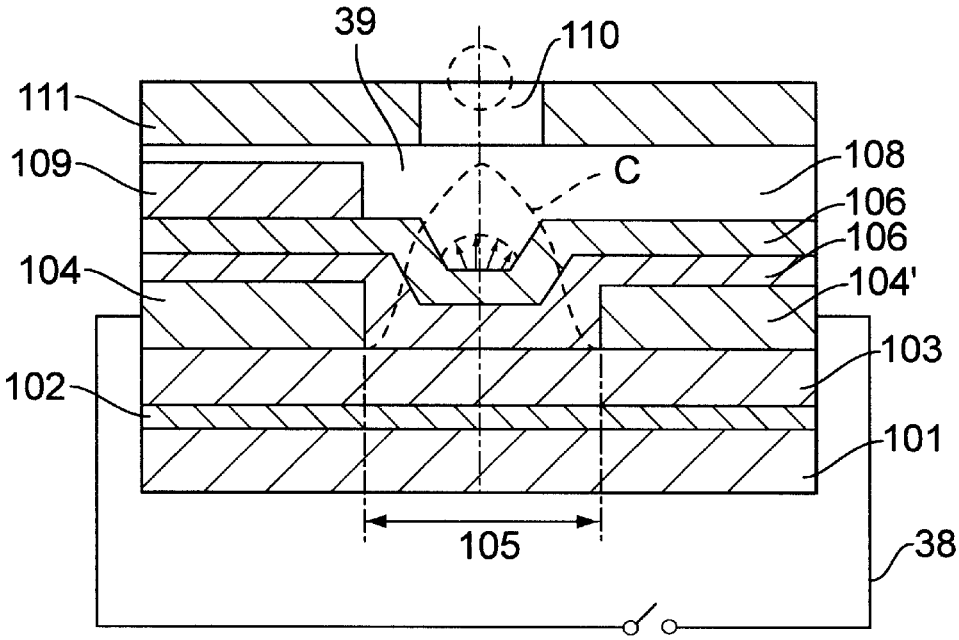
FIG. 6 shows the ink spraying mechanism in accordance with the earlier art.

The ink spraying mechanism of the earlier ink-jet printer head is now described referring to FIG. 6. Head driver 30 furnishes electric energy to a pair of electrodes 104 and 104' in response to a control instruction of CPU 10 that receives a command to print through the printer interface. The power is transmitted through two electrodes 104 and 104' to heat heating portions 105 by the heat of electrical resistance, i.e. joule heat ($P=I^2R$) for a predetermined period of time. The top surface of heating portions 105 is heated to 500 C–550 C to transmit the heat to multi-layer protective layers 106. At this point, the heat is transmitted to the ink particles across the protective layers 106. The highest steam pressure develops in the central area C of the heating portions 105, which is therefore where the highest concentration of bubbles occurs. The ink bubbles, produced by this heat, cause a change in the volume of the ink above heating portions 105. Ink particles that are pushed as the volume of ink is changed are jetted out through orifices 110 of nozzle plate 111.

If the electric energy finished to two electrodes 104 and 104' is cut off, heating portions 105 cool instantaneously, and the ink bubbles are deflated whereby the ink returns to its original state. The ink particles, discharged to the outside, are sprayed on paper in the shape of small drops by surface tension, thus forming characters on paper in a dot-matrix format. The ink chamber's internal pressure drops according to the change in the bubble volume, and the ink from the ink container refills nozzle plate 111 through ink via 34.

The earlier ink spraying mechanism, using the earlier ink-jet printer head, has the following disadvantages. First, when forming bubbles by the super-heat so as to spray the ink on print media, the composition of the ink may be changed by the heat, and a shock wave, created by the generation and bursting of the ink bubbles deteriorates the internal components of the head. Second, as the ink adheres to the resistor 103 and two electrodes 104 and 104', with protective layers 106 being interposed, they interact electrically, and, accordingly, corrosion occurs by the ion exchange at each boundary layer of heating portions 105 and two electrodes 104 and 104', thus reducing the head life. Third, the shock wave, created by the generation of ink bubbles in ink barrier 109 containing the ink, causes an increase of the time required for refilling the ink chamber, known as the recharge time or refresh cycle. Fourth, the shape of the bubbles affects the advance, circularity and uniformity of the ink drop, which therefore affects printing quality.

Figure 7:
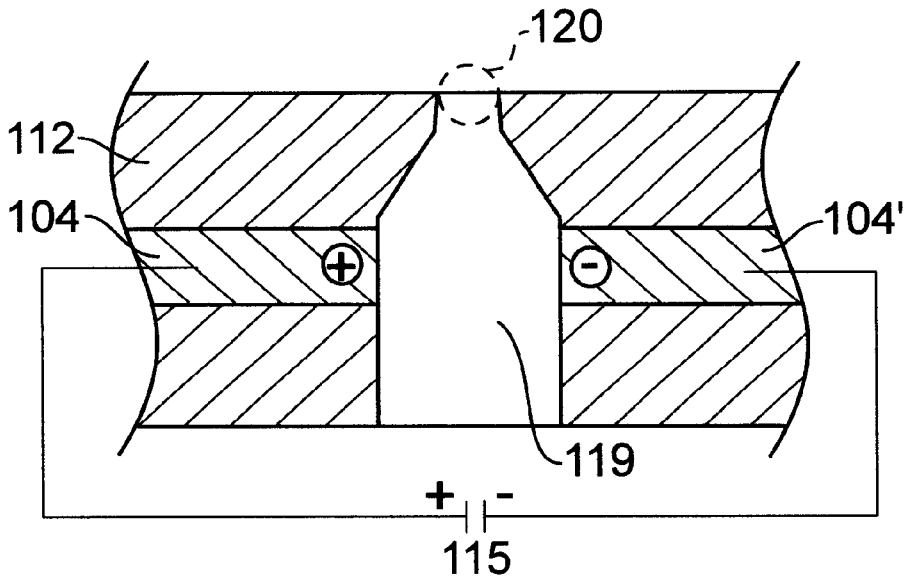
FIG. 7 is a sectional view of an ejector according to the earlier art.

FIG. 7 is a sectional view of an earlier ejector. Referring to FIG. 7, electrodes 104 and 104' formed on a substrate 101 have opposite polarities and are connected to each other through an electrical connection 115. An insulating layer 112 is formed on the electrodes 104 and 104'. A hole piercing through the respective layers is a nozzle 120 whose top end forms an orifice. Through the narrow orifice, ink particles are ejected by way of a progression of the ink's negative and positive meniscus states within the nozzle.

When high voltage of about 1 kV to 3 kV is applied across the two electrodes 104 and 104' with an impulse duration in the 40 $\mu$s to 60 $\mu$s range, the ink is boiled by joule heat given by $P=I^2R$. The heated ink can be ejected from the orifice of the nozzle by means of its increased vapor pressure. The ink used is a conductive ink.

Figure 8:
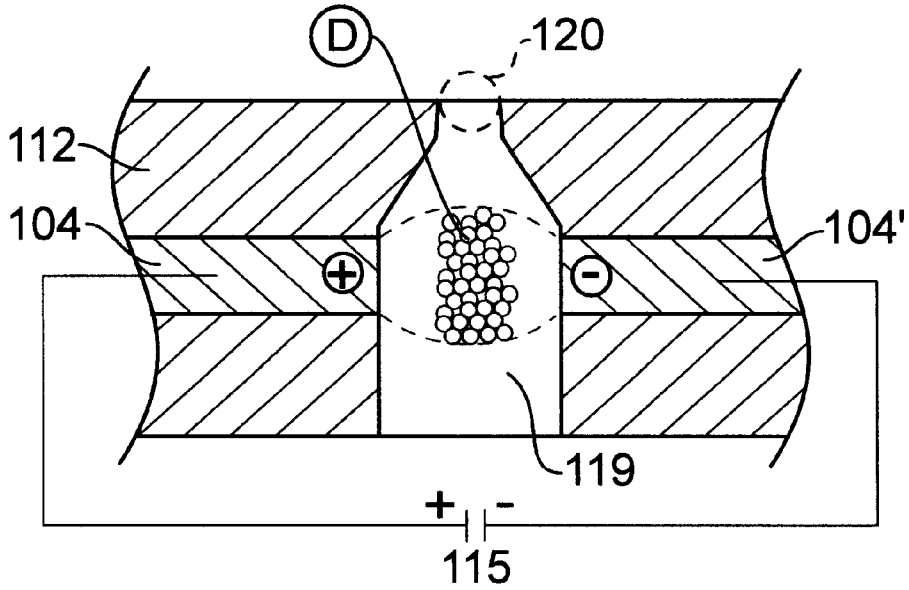
FIG. 8 is an exemplary view illustrating the operation of the ejector as constructed in FIG. 7.

FIG. 8 is an exemplary view illustrating the operation of the ejector as constructed in FIG. 7. When applying high voltage to the electrodes 104 and 104', bubbles generated at the edges of the electrodes accelerate the ink of meniscus form into the media. According to the earlier art, it is impossible to realize a high speed printing operation because the ejector requires high voltage and long pulse duration. Another problem of the prior art is a rapid corrosion at the edges of the electrodes due to the bubbles generated between the edges of the two electrodes by the joule heat of $P=I^2R$.

Figure 9:
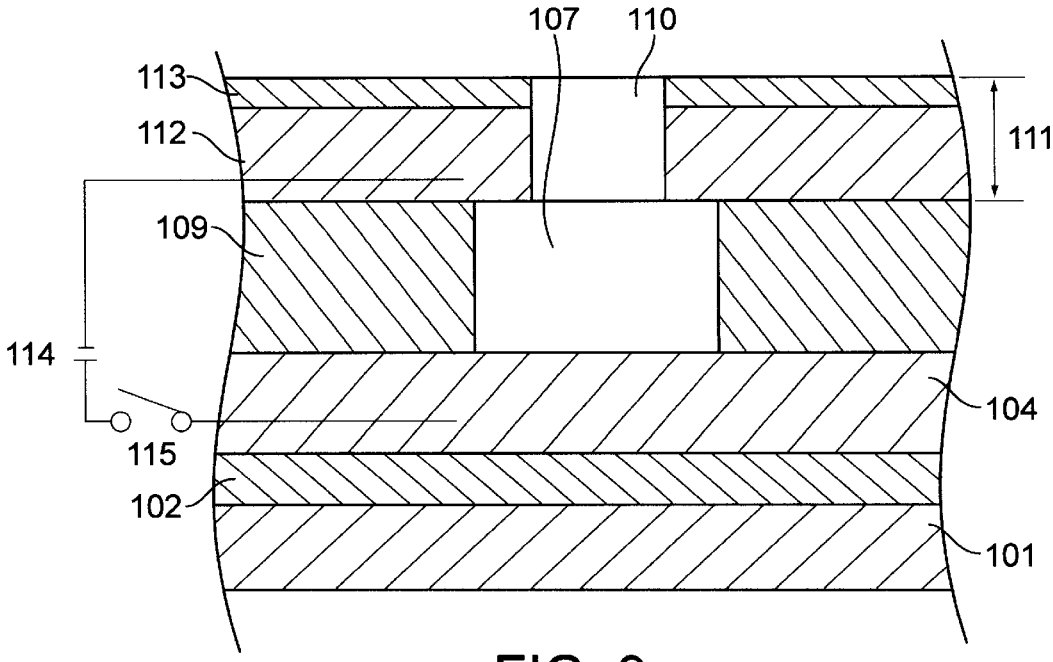
FIG. 9 is a sectional view of an ejector of an ink-jet printer in accordance with a first preferred embodiment of the present invention.

FIG. 9 is a sectional view of an ejector of an ink-jet printer in accordance with a first preferred embodiment of the present invention Referring to FIG. 9, the ejector is made up of a plurality of individual electrodes 104 formed on a thin silicon dioxide ($SiO_2$) layer 102 on the support of a silicon substrate 101, wetted with ink in a specified portion thereof with the other portion electrically isolated, and supplied with positive (+) electric power; nozzle plate 111 electrically separated from the individual electrodes 104 as a common electrode, producing an electrolysis in the ink by the electric power applied with the individual electrodes 104, wetted with the ink in a specified portion thereof, and including a plurality of openings 110 through which the ink is ejected into media, conductive layers 112 surrounding the openings 110, and insulating layers 113 covering the conductive layers 112; ink barriers 109 electrically separating, the ink-wetted portions of the individual electrodes 104 from one another, providing a fluid path to transfer the ink from an ink via into an ink chamber through an ink channel, and making an ejection force and linearity of vapor pressure increase when the ink is induced to the openings on the nozzle plate; ink chambers 107 receiving the ink guided by the ink barriers 109, providing a space for an electrolysis to occur by the electric energy applied across the individual electrodes 104 and nozzle plates 111 to generate bubbles of gas on the surface of the individual electrodes; electric connections 114 for applying positive (+) voltage to the individual electrodes 104 but negative (−) voltage to the conductive layers 112 to cause an electrolysis by the two electrodes; and a switching device 115 for electrically switching the electric connection 114 by the head control signal of a CPU (not shown) generated according to a printing command. The ink barriers 109 are perforated by a orifice to form ink chamber 107conductive layer 112 is perforated by another orifice concentric to the ink chamber 107 for ejecting ink.

The individual electrodes 104 and the conductive layers 112 of the nozzle plate 111 are made of an alloy of nickel and platinum to prevent a corrosive action of the conductive ink and ions. The conductive ink contained in the ink chambers 107 has a resistance in the range of 0 to 50 ohms, preferably, 0 to 10 ohms. The thickness of the conductive layers 112 formed in the nozzle plate 111 can be 5 $\mu$m to 200 $\mu$m, preferably, 5 $\mu$m to 10 $\mu$m.

Figure 10:
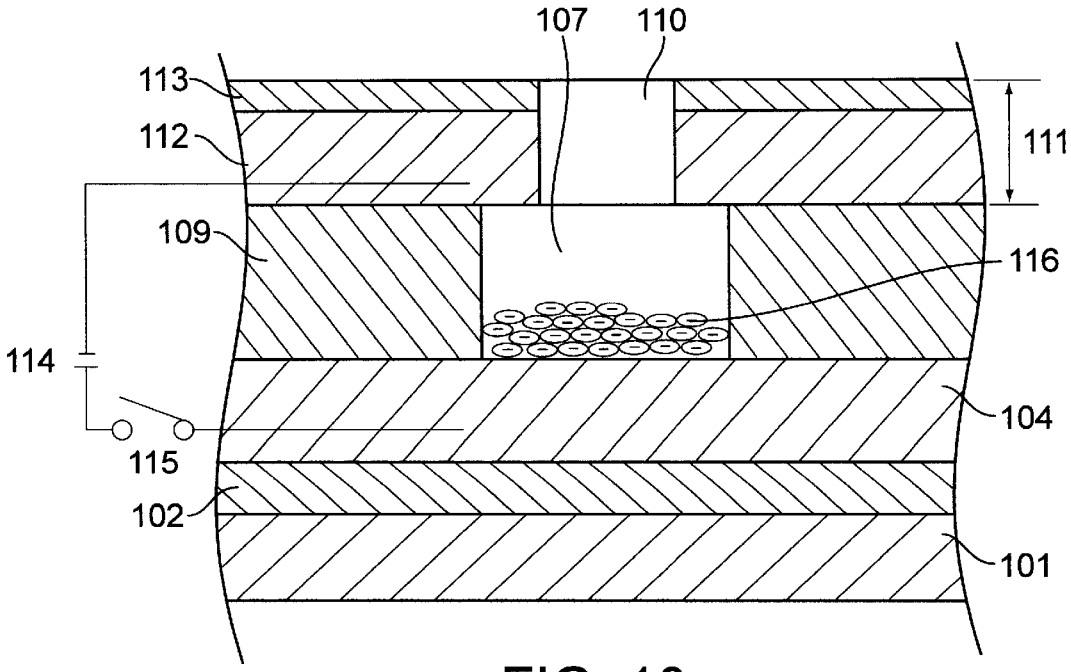
FIG. 10 is an exemplary view illustrating the operation of the ejector as constructed in FIG. 9.

Referring to FIG. 10, the conductive ink is transferred from the ink stand pipe chamber 33 into the ink chambers through the ink via 34. The ink forms a meniscus in the opening 110 of the nozzle plate 111 formed on the ink chambers 107 and is ejected by an osmotic pressure.

To print data in a memory from the CPU, electric energy is transferred from a head driver (not shown) to the individual electrode 104 concerned and the conductive layers 112 of the nozzle plate 111 to form characters in a designated position on paper.

Positive (+) voltage is applied to the individual electrode 104 and negative (−) voltage is applied to the conductive layer 112.

The power applied across the individual electrodes 104 and conductive layers 112 is DC voltage in the 10 V to 15 V range with an impulse duration between 2 $\mu$s and 4 $\mu$s. This means that the individual electrodes and conductive layer are operated with a signal of high frequency or about 15 kHz. Current flows through the conductive ink having a resistance component wetted to be conductive between the individual electrodes 104 and conductive layer 112. Thus, a conduction path is established between the individual electrodes 104 of the positive polarity on the ink chambers 107 and the conductive layer 112 of the negative polarity around the openings 110 of the nozzle plate 111, through the conductive ink in the ink chambers 107.

The conductive ink is electrolyzed into positive ions and negative ions 116 by the electric energy applied to the individual electrodes 104 and conductive layers 112. The negative ions 116 move to the surface of the individual electrodes 104 having the positive polarity while the positive ions move to the conductive layers 112 of the negative polarity. The ink is a conductive water-based solution containing a small amount of catalyst such as sodium chloride (NaCl) so that oxygen ($O_2$) bubbles are generated on the surface of the individual electrodes 104 of the positive polarity. The amount of the oxygen bubbles increases with a longer impulse duration of the voltage applied to the individual electrodes 104. It can be also increased with the greater ink conductivity and the magnitude of the voltage applied to the cathodes and anodes, that is, individual electrodes 104 and conductive layers 112.

The vapor pressure of oxygen bubbles drastically increases on the surface of the individual electrodes 104 forcing the ink contained in the ink chambers 107 to move to the openings 110, that is, orifices, to form an image on the media. If the impulse duration is too long or the voltage applied is excessively high, joule heat generated as in the earlier art causes an energy consumption given by $P=I^2R$. This may increase the vapor pressure of the bubbles produced on the surface of the individual electrodes 104, but the earlier art is not applicable to a printing operation of high frequency that is above 5 kHz. The present invention makes it possible to realize a high-speed printing operation having a frequency of 15 kHz, with an applied voltage of 15 V or less and an impulse duration of around 3 $\mu$s.

The vapor pressure of oxygen bubbles on the surface of the individual electrode 104 is increased enough to eject the ink to the openings. The ink can be uniformly ejected with uniform distributions in the vapor pressure and electric current density since the oxygen gas is generated on the surface of the individual electrodes 104 of the positive polarity instead of the edges of the electrodes 104 as seen in the earlier art. It can be seen that the oxygen bubbles are generated on the surface of the individual electrodes and then combine with one another into larger oxygen bubbles with greater volume, to thereby increase the vapor pressure.

When applying electric energy for a given time, the oxygen gas is successively generated on the surface of the individual electrodes 104, which results in the increase of the vapor pressure and volume of the ink in the ink chambers 107. The ink that has expanded in the ink chambers 107 exits through the openings 110 of the nozzle plate 111 to form a drop. By interrupting the electric energy applied to the individual electrodes 104 and conductive layers 112, the oxygen bubbles disappear with the accompanying drop in internal pressure. The drops of ink are ejected into the print media.

Due to a drop in the internal pressure, the ink in the ink stand pipe chamber (not shown) flows through the ink via and ink channel to refill the ink chambers 107. Repeated operations of ejecting and refilling the ink reproduces a desired image on the media.

The basic operational principle of the present invention is that, due to an electrolysis that occurs by a current flowing through the conductive ink when electric energy is applied across the individual electrodes 104 wetted with ink in the ink chambers 107 and the conductive layers 112 of the nozzle plate 111, oxygen gas is generated on the surface of the individual electrodes 104 having the positive polarity to increase the vapor pressure and eject the ink out of the openings 110.

The conductive layers 112 of the nozzle plate 111 makes current flow through a limited portion of the individual electrodes 104 that is wetted with the conductive ink in the ink chambers 107. This restriction in current flow increases the electric current density per unit area and makes it easy to realize a high frequency driving operation.

The insulating layer 113 of the nozzle plate 111 serves as a preventative measure against current leakage, which tends to occur under certain print media conditions. The current applied to the individual electrodes and the conductive layers of the nozzle plate is 0.1 A or less.

Ink barriers 109 are adhered to the nozzle plate 111 by using glue as an additive. Ink barriers 109 are sealed with the nozzle plates by means of a heat fusion method. The switching devices comprise transistors.

Figure 11:
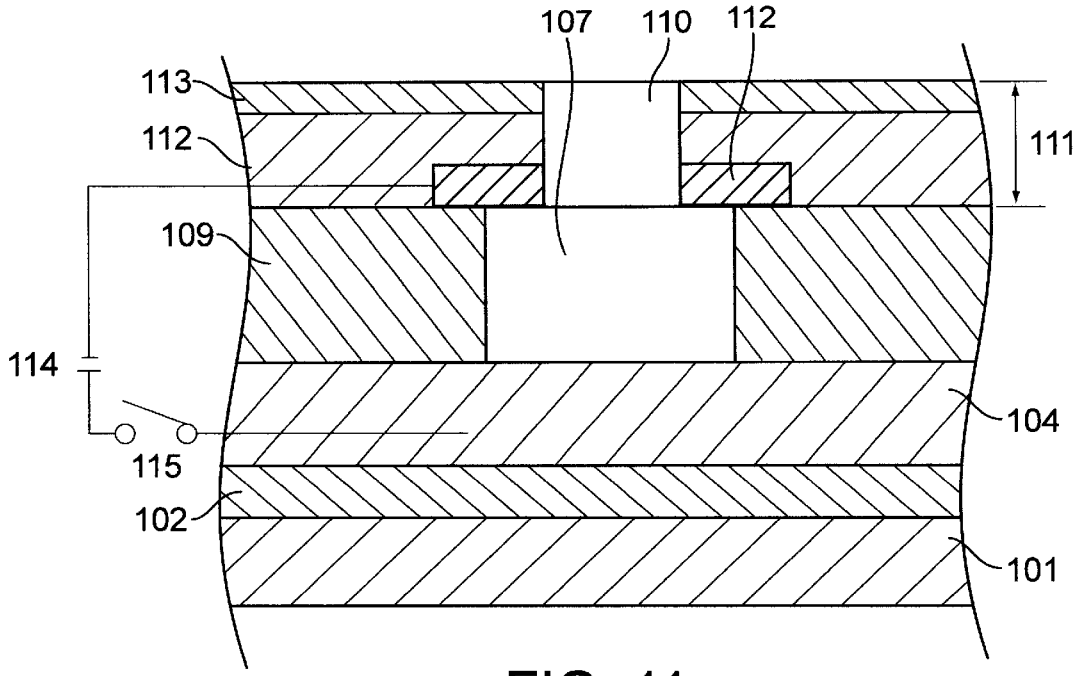
FIG. 11 is a sectional view of an injector of an ink-jet printer in accordance with a second preferred embodiment of the present invention.

FIG. 11 is a sectional view of an ejector of an ink-jet printer in accordance with a second preferred embodiment of the present invention. Unlike the first embodiment as shown in FIG. 9, the conductive layer 112 formed in nozzle plate 111 having a plurality of openings 110 are donut-shaped. The conductive layer 112 surround the openings 110 to maintain the electric current density in ink chamber 107 by the nozzle plate 111. Thus stabilized, the electrolysis in the chamber 107 enhances the quality of characters formed on media.

Figure 12:
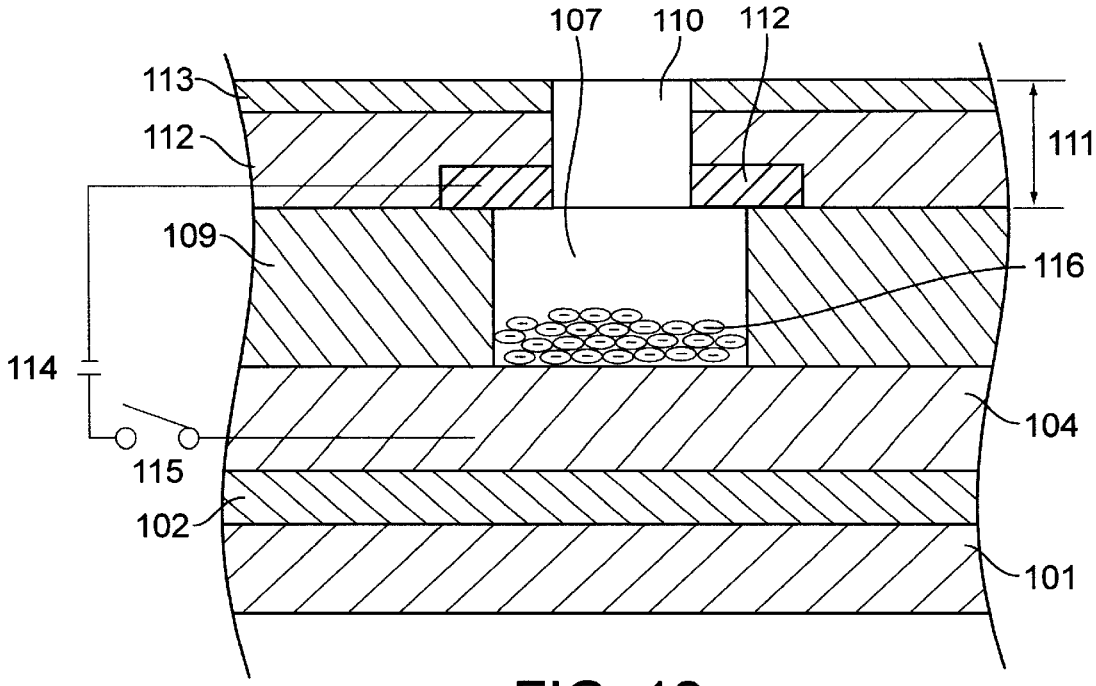
FIG. 12 is an exemplary view illustrating the operation of the ejector as constructed in FIG. 11.

FIG. 12 is an exemplary view illustrating the operation of the ejector as constructed in FIG. 11. Oxygen gas is generated on the surface of the individual electrodes 104 in the same manner with the first embodiment as shown in FIG. 9.

Figure 13:
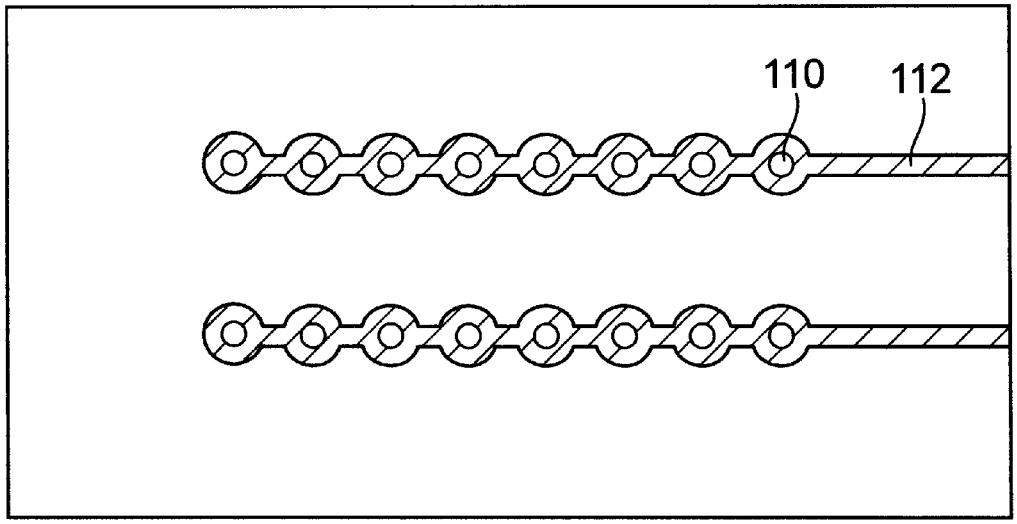
FIG. 13 is a plan sectional view of the nozzle plate as shown in FIG. 11.

FIG. 13 is a plan sectional view of the openings 110 of the nozzle plate 111 as constructed in FIG. 11. Referring to FIG. 13, donut-shaped conductive layer 112 surround the openings 110.

Figure 14:
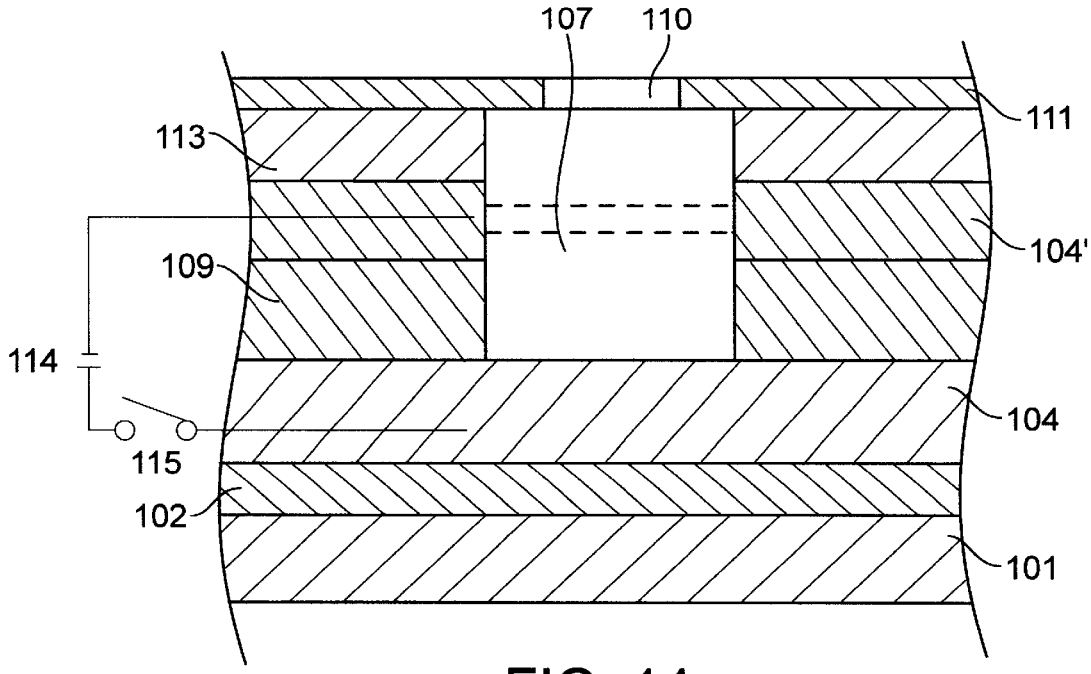
FIG. 14 is a sectional view of an ejector of an ink-jet printer in accordance with a third preferred embodiment of the present invention.

FIG. 14 is a sectional view of an ejector of an ink-jet printer in accordance with a third preferred embodiment of the present invention. This embodiment is different in construction from the first and second embodiments but identical to them in basic principle. Referring to FIG. 14, the ejector is made up of first electrodes 104 located on a substrate 101 whose surface is treated with silicon dioxide, wetted with ink in a specified portion to generate bubbles in the ink with the other portion being isolated by an insulating layer, and being applied with positive (+) voltage; a second electrodes 104' electrically isolated from the first electrodes 104, wetted with the ink in a specified portion, and being applied with negative (−) voltage to produce an electrolysis in the ink with the first electrodes supplied with the positive (+) voltage and generate the bubbles; a first ink barrier 109*a* for electrically isolating between the first and second electrodes and providing walls for forming fluid paths and ink chambers through ink channels; nozzle plate 111 having a plurality of openings through which the ink is ejected onto media; a plurality of second ink barriers 109*b* formed between the second electrodes and nozzle plate to provide the wall of the ink chambers and electrically isolate between the second electrodes and nozzle plate; ink chambers 107 surrounded by the first and second electrodes, first and second ink barriers and nozzle plate, and providing a space for receiving the ink from the ink channels; electrical connectors 114 for supplying positive (+) voltage to the first electrodes and negative (−) voltage to the second electrode ; and a switching devices 115 for controlling the switching operation of the electrical connectors to regulate the electric power and impulse duration. The first ink barrier, the second ink barrier, and the second electrode 104' are all perforated by an orifice of coinciding size and shape to form ink chamber 107. Nozzle plate 111 is perforated by another orifice that is concentric to the orifices that define ink chamber 107 and is used to eject ink from the ink chamber 107.

Figure 15:
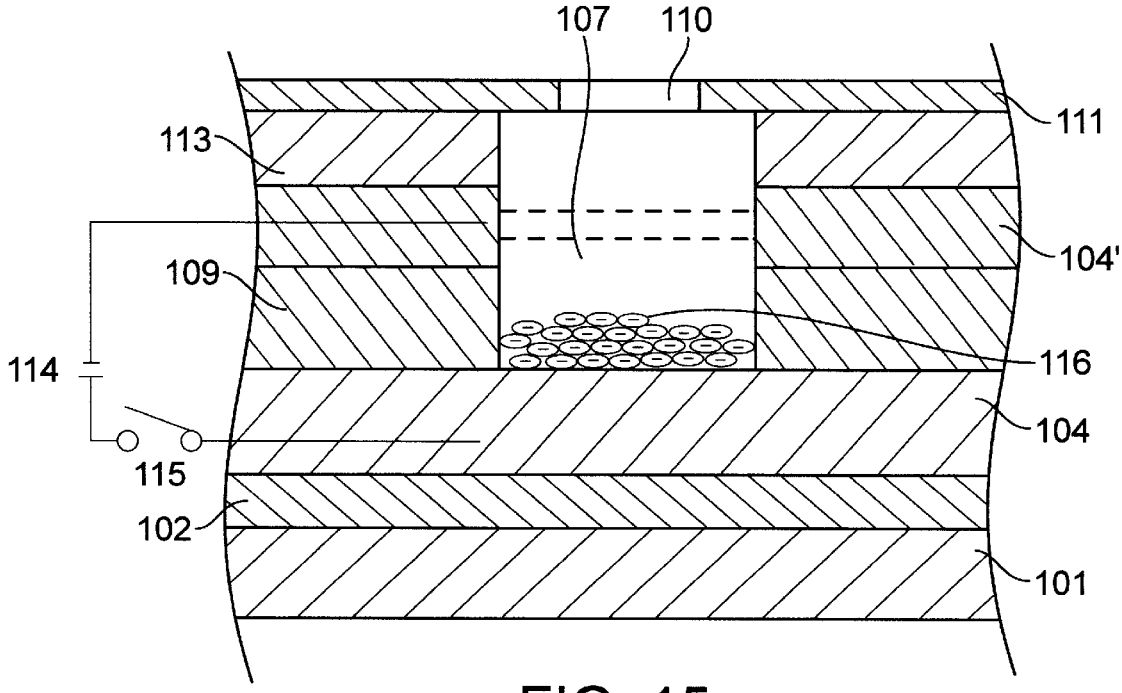
FIG. 15 is an exemplary view illustrating the operation of the ejector as constructed in FIG. 14.

FIG. 15 is an exemplary view illustrating the operation of the ejector as constructed in FIG. 14. Oxygen gas is generated on the surface of the first electrode 104 having the positive polarity and the operation is the same with the proceeding embodiments.

In the construction of an earlier ejector, the ink is heated by a heater made up of electrodes and resistances, or the ink is injected by the bubbles generated between the edges of the two electrodes formed in a head. Unlike the earlier art, the insulating layer electrically isolates the individual electrodes in a position for a character to be formed from the nozzle plate used as a common electrode by using an insulating layer. According to the present invention, the ink can be ejected out of the openings on the nozzle plate onto print media by the vapor pressure of bubbles of gas generated in the electrolysis of the conductive ink by applying positive (+) voltage to individual electrodes wetted with the ink and negative (−) voltage to a common electrode. In the present invention, the polarities of the individual electrodes, or first electrodes, and that of the common electrodes, or second electrodes, are interchangeable.

In contrast to the earlier art, the present invention requires no protection layer to protect the internal electrodes in a head construction and has no problem of damaging the surface of the heater by the heat generated therefrom. Heat-resistant ink is not required in the present invention whereby the ink is injected by the bubbles generated on the surface of the individual electrode due to an electrolysis without contacting a heater.

The present invention is applicable to a high speed printing operation for high frequency since a short impulse duration of low voltage is employed instead of a long impulse duration of high voltage to generate an electric energy by joule heat.

Since the bubbles are generated on the surface of the individual electrodes rather than at the edges of the electrodes, the corrosion can be reduced due to a uniform distribution of electric current.

It will be apparent to those skilled in the art that various modifications and variations can be made in the apparatus for and method of ejection in an ink-jet printer according to the present invention without departing from the spirit or scope of the invention. Thus, it is intended that the present invention cover the modifications and variations of this invention provided they come within the scope of the appended claims and their equivalents.

What is claimed is:

1. An apparatus for ejecting ink of an ink-jet printer, the apparatus comprising:

a substrate;

a first electrically insulating layer disposed upon said substrate;

a first electrode layer disposed upon said first insulating layer, said first electrode layer containing at least one electrode;

a second electrically insulating layer built upon said first electrode layer;

a second electrode layer built upon said second electrically insulating layer, said second electrode layer containing at least one electrode opposing one of said electrodes from said first electrode layer; and a third insulating layer built upon said second electrode layer, said third insulating layer and said second electrode layer being perforated by a first orifice, said second electrically insulating layer being perforated by a second orifice, wherein oxygen bubbles are formed on said first electrode layer by an electrolysis of said ink when 0.1 amps or less current is applied to said first and said second electrode layers and wherein the potential difference between said first and said second electrode layers is 10 volts to 15 volts DC and wherein said current and voltage applied to said electrode layers are impulses of 2 microseconds to 4 microseconds in duration.

2. The apparatus as defined in claim 1, wherein the ink is a conductive ink.

3. The apparatus as defined in claim 2, wherein the conductive ink has a resistance of 10 ohms or less.

4. The apparatus as defined in claim 1, wherein the ink contains sodium chloride as a catalyst for an electrolysis of said ink.

5. The apparatus as defined in claim 1, wherein the first and second electrodes layers are made of an alloy of nickel and platinum.

6. The apparatus as defined in claim 1, wherein said second insulating layer is adhered to said second electrode layer by using glue.

7. The apparatus as defined in claim 1, wherein said second insulating layer is sealed to said second electrode layer by means of a heat fusion method.

8. The apparatus as defined in claim 1, wherein the second electrode layer surround outer parts of said second orifice.

9. The apparatus as defined in claim 1, wherein the second electrode layer is of a doughnut-shape and surrounds a bottom part of said first orifice.

10. The apparatus as defined in claim 1, further comprised of switching devices that comprise transistors for controlling the switching operation of electrical connectors to regulate said impulse duration.

11. The apparatus as defined in claim 1, wherein said first orifice is coaxially aligned to said second orifice, wherein said first electrode layer lies beneath said first orifice and said second orifice.

12. The apparatus as defined in claim 11, wherein said first orifice and said second orifice are cylindrical in shape, said first orifice has a first diameter that is smaller than a second diameter defining said second orifice, said first orifice and said second orifice being concentric.

13. The apparatus as defined in claim 12, wherein said second orifice forms an ink chamber where ink is electrolyzed wherein oxygen bubbles gather upon said first electrode layer upon application of said current and said voltage, causing a droplet of ink to be ejected from said first orifice.

14. The apparatus of claim 1, wherein said first electrically insulating layer being silicon dioxide.

15. The apparatus of claim 1, further comprising:

an electrical connection connecting said first electrode layer to said second electrode layer;

a switching device on said electrical connection; and a voltage source on said electrical connection allowing said impulse of said voltage and said current to be applied between said first and said second electrode layers.

16. An apparatus for ejecting ink of an ink-jet printer, the apparatus comprising:

a substrate;

a first electrically insulating layer disposed upon said substrate;

a first electrode layer disposed upon said first electrically insulating layer, said first electrode layer containing at least one electrode;

a second electrically insulating layer built upon said first electrode layer;

a second electrode layer built upon said second electrically insulating layer, said second electrode layer containing at least one electrode opposing one of said electrodes from said first electrode layer;

a third electrically insulating layer built upon said second electrode layer; a circuit connected between said first electrode layer and said second electrode payer, said circuit applying 0.1 amps of electrical current or less to said first and second electrode layers and producing an electrolysis in said ink causing ejection of said ink through said second cylindrical orifice; and a nozzle plate built upon said third electrically insulating layer, said second electrically insulating layer, said third electrically insulating layer and said second electrode being perforated by a first cylindrical orifice having a first diameter, said first cylindrical orifice comprising an ink chamber, said nozzle plate being perforated by a second cylindrical orifice having a diameter smaller than said diameter of said first cylindrical orifice, said second cylindrical orifice being concentric to said first cylindrical orifice.

17. The apparatus as defined in claim 16, further comprising said circuit applying 10 volts to 15 volts DC between said first electrode layer and said second electrode layer, said circuit applying power to said first and second electrode layers in impulses of a duration between 2 microseconds and 4 microseconds.

18. The apparatus as defined in claim 17, wherein said ink is conductive with a resistance of 10 ohms or less.

19. The apparatus as defined in claim 17, wherein the ink contains sodium chloride to activate a conductivity.

20. The apparatus as defined in claim 17, wherein said first electrode layer and said second electrode layer are made of an alloy of nickel and platinum.

21. The apparatus as defined in claim 17, wherein said second electrically insulating layer is adhered to said second electrode layer by using glue.

22. The apparatus as defined in claim 17, wherein said second electrically insulating layer is sealed with the second electrode layer by means of a heat fusion method.

23. The apparatus as defined in claim 17, further comprising switching devices that comprise transistors for controlling the switching operation of electrical connectors to regulate said impulse duration.

24. The apparatus of claim 16, wherein said first electrically insulating layer is silicon dioxide.

25. The apparatus of claim 16, wherein said first electrode layer lies beneath said first cylindrical orifice and said second cylindrical orifice.

26. The apparatus as defined in claim 16, wherein said second orifice is coaxially aligned to said first orifice, wherein said first electrode layer lies beneath said first orifice and said second orifice.

27. The apparatus as defined in claim 26, wherein said first orifice has a first diameter that is larger than a second diameter defining said second orifice, said first orifice and said second orifice being concentric.

28. The apparatus as defined in claim 27, wherein said ink within said ink chamber is electrolyzed wherein oxygen bubbles gather upon said first electrode layer upon application of a current impulse and a voltage impulse between said first and said second electrode layers, causing a droplet of ink to be ejected from said second orifice.

29. An apparatus for ejecting ink from an ink-jet printer via an electrolysis of said ink, said apparatus comprising:

a substrate;

a first electrically insulating layer disposed upon said substrate;

a first electrode layer disposed upon said first insulating layer;

a second electrically insulating layer built upon said first electrode layer;

a second electrode layer built upon said second electrically insulating layer; and a third electrically insulating layer built upon said second electrode layer, said third electrically insulating layer and said second electrode layer being perforated by a first orifice, said second electrically insulating layer being perforated by a second orifice coaxially aligned to and bigger than said first orifice, wherein oxygen bubbles are formed on said first electrode layer by an electrolysis of said ink upon delivering an electrical impulse of power in an application of a current of 0.1 Amperes or less between said first electrode layer and said second electrode layer causing a droplet of ink to be ejected from said first orifice, said first electrode layer being positioned beneath all of said first orifice and all of said second orifice.

30. The apparatus of claim 29, further comprising:

an electrical connection connecting said first electrode layer to said second electrode layer;

a switching device on said electrical connection; and a voltage source on said electrical connection allowing said impulse of current to be applied between said first and said second electrode layers.

31. The apparatus of claim 30, wherein said switching device comprises transistors for controlling a switching operation of electrical connectors to regulate said impulse duration.

32. The apparatus as defined in claim 29, wherein said second electrode layer is of a doughnut-shape and surrounds a bottom part of said first orifice and a top part of said second orifice.

33. The apparatus of claim 29, wherein said second electrode layer is adhered to said second electrically insulating layer by using glue, said second electrode layer is sealed to said second electrically insulating layer by a heat fusion method.

34. The apparatus of claim 29, wherein said ink forms a meniscus in said first orifice and is ejected by osmotic pressure.

35. The apparatus of claim 29, wherein a thickness of said second electrode layer is 5 $\mu$m to 10 $\mu$m.

36. The apparatus of claim 29, wherein said electrical impulse of power comprises 10 to 15 volts DC applied between said first electrode layer and said second electrode layer, and an impulse duration of 2 to 4 microseconds.

* * * * *